US007604497B2

(12) United States Patent
Wu et al.

(10) Patent No.: US 7,604,497 B2
(45) Date of Patent: Oct. 20, 2009

(54) ELECTRICAL CONNECTOR WITH IMPROVED LATCH

(75) Inventors: Lin Wu, Kunshan (CN); David Tso-Chin Ko, Cypress, CA (US); Wei-Ya Cheng, Kunshan (CN); Hai-Wei Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/151,538

(22) Filed: May 7, 2008

(65) Prior Publication Data

US 2008/0280479 A1 Nov. 13, 2008

(30) Foreign Application Priority Data

May 7, 2007 (CN) ..... 2007 2 0037351

(51) Int. Cl.
*H01R 13/627* (2006.01)

(52) U.S. Cl. ..... 439/358

(58) Field of Classification Search ..... 439/353, 439/358

See application file for complete search history.

(56) References Cited

U.S. PATENT DOCUMENTS

| | | | |
|---|---|---|---|
| 5,609,499 | A | 3/1997 | Tan |
| 6,558,183 | B1 | 5/2003 | Ji |
| 6,648,668 | B1 | 11/2003 | Ko |
| 6,966,789 | B2 | 11/2005 | Takaku |

*Primary Examiner*—Briggitte R Hammond
(74) *Attorney, Agent, or Firm*—Wei Te Chung; Andrew C. Cheng; Ming Chieh Chang

(57) ABSTRACT

An electrical connector (100) includes an insulator (2), a conductive terminal (3) held in the insulator, a latch (4) and a button (5). The insulator comprises a pair of guide posts (21) on both sides of the front thereof and a pair of arm portions (22) on both sides of the rear thereof, a recess (221, 222) disposed in the arm portion and extending into the guide post. The latch is received and held in the recess of the insulator, and comprises a holding portion (41) received in the arm portion for holding the latch in the insulator, an engaging portion (42) extending forwards from the front of the holding portion and received in the guide post for engaging with a complementary connector, a spring portion (43) extending outwards and forwards from the rear of the holding portion, and a driving portion (442) extending forwards from the spring portion to approach the engaging portion so as to drive the engaging portion by pressure. The button is mounted on the spring portion and covers the latch.

15 Claims, 6 Drawing Sheets

ELECTRICAL CONNECTOR WITH IMPROVED LATCH

BACKGROUND OF THE INVENTION

1. Field of the Invention

This invention generally relates to an electrical connector, and more particularly, to an electrical connector with an improved latch for locking with a complementary connector.

2. Description of the Prior Art

U.S. Pat. No. 6,558,183 discloses an electrical connector comprising a housing with a plurality of contacts thereof and a pair of lock members for locking the housing with the complementary connector. However, a pair of upper and lower cases are needed to hold the latch therein, so the dimension of the electrical connector is to become large.

Hence, an improved electrical connector is desired to overcome the above problems.

BRIEF SUMMARY OF THE INVENTION

It is an object of the present invention to provide an electrical connector with a small dimension and a stable latch.

In order to attain the object above, an electrical connector according to the present invention comprises an insulator, a conductive terminal held in the insulator, a latch and a button. The insulator comprises a pair of guide posts on both sides of the front thereof and a pair of arm portions on both sides of the rear thereof, a recess disposed in the arm portion and extending into the guide post. The latch is received and held in the recess of the insulator, and comprises a holding portion received in the arm portion for holding the latch in the insulator, an engaging portion extending forwards from the front of the holding portion and received in the guide post for engaging with a complementary connector, a spring portion extending outwards and forwards from the rear of the holding portion, and a driving portion extending forwards from the spring portion to approach the engaging portion so as to drive the engaging portion by pressure. The button is mounted on the spring portion and covers the latch.

It is an object of the present invention to provide an electrical connector with an improved latch.

In order to attain the object above, an electrical connector according to the present invention comprises an insulator, a conductive terminal held in the insulator, and a latch. The insulator comprises a pair of guide posts on both sides of the front thereof and a pair of arm portions on both sides of the rear thereof, a recess disposed in the arm portion and extending into the guide post. The latch comprises a holding portion received in the arm portion for holding the latch in the insulator, an engaging portion extending forwards from the front end of the holding portion and received in the guide post for engaging with a complementary connector, a spring portion extending outwards and forwards from the rear end of the holding portion, and a pressed portion connecting with the spring portion and located outside the engaging portion to drive the engaging portion by pressure.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
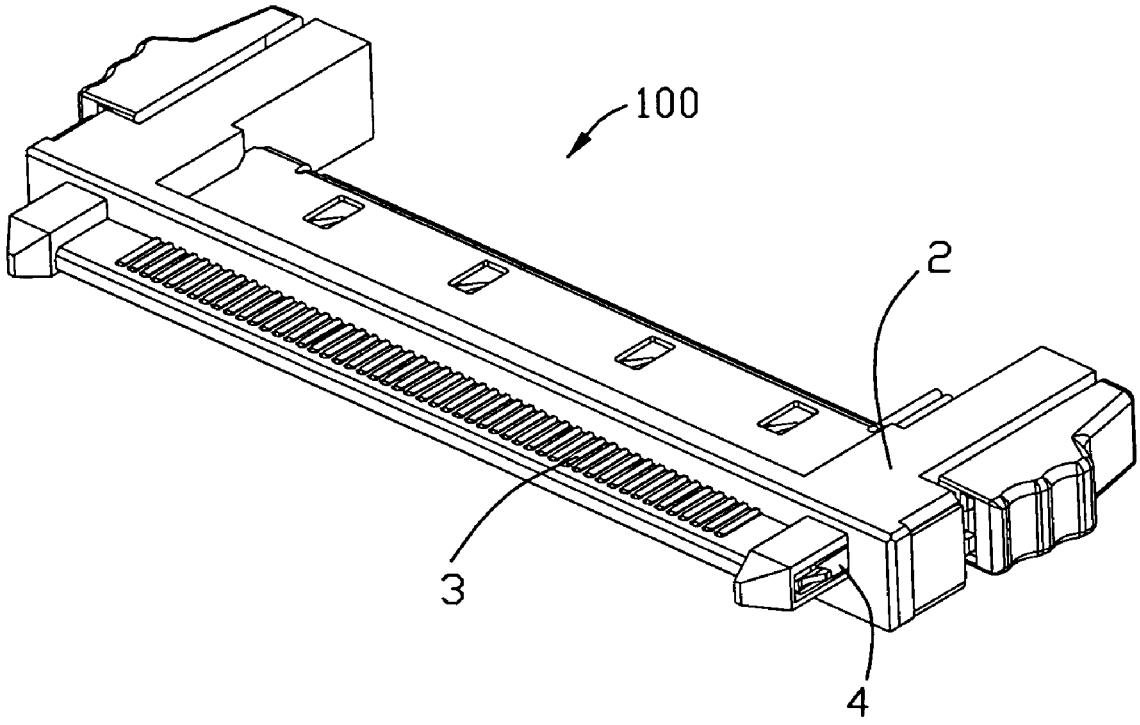
FIG. 1 is an assembled view of an electrical connector in accordance with the present invention.

Reference will now be made in detail to the preferred embodiment of the present invention.

As shown in FIGS. 1-6, an electrical connector 100 according to the present invention is used in a LCD TV, and comprises an insulator 2, a plurality of conductive terminals 3, and a latch 4 held by the insulator 2.

The insulator 2 comprises a tongue plate 20 with a plurality of terminals 3 thereof, a pair of guide posts 21 on both sides of the tongue plate 20 to guide the insulator 2 to mate with a complementary connector, and a pair of arm portions 22 on both sides of the rear end thereof.

Figure 2:
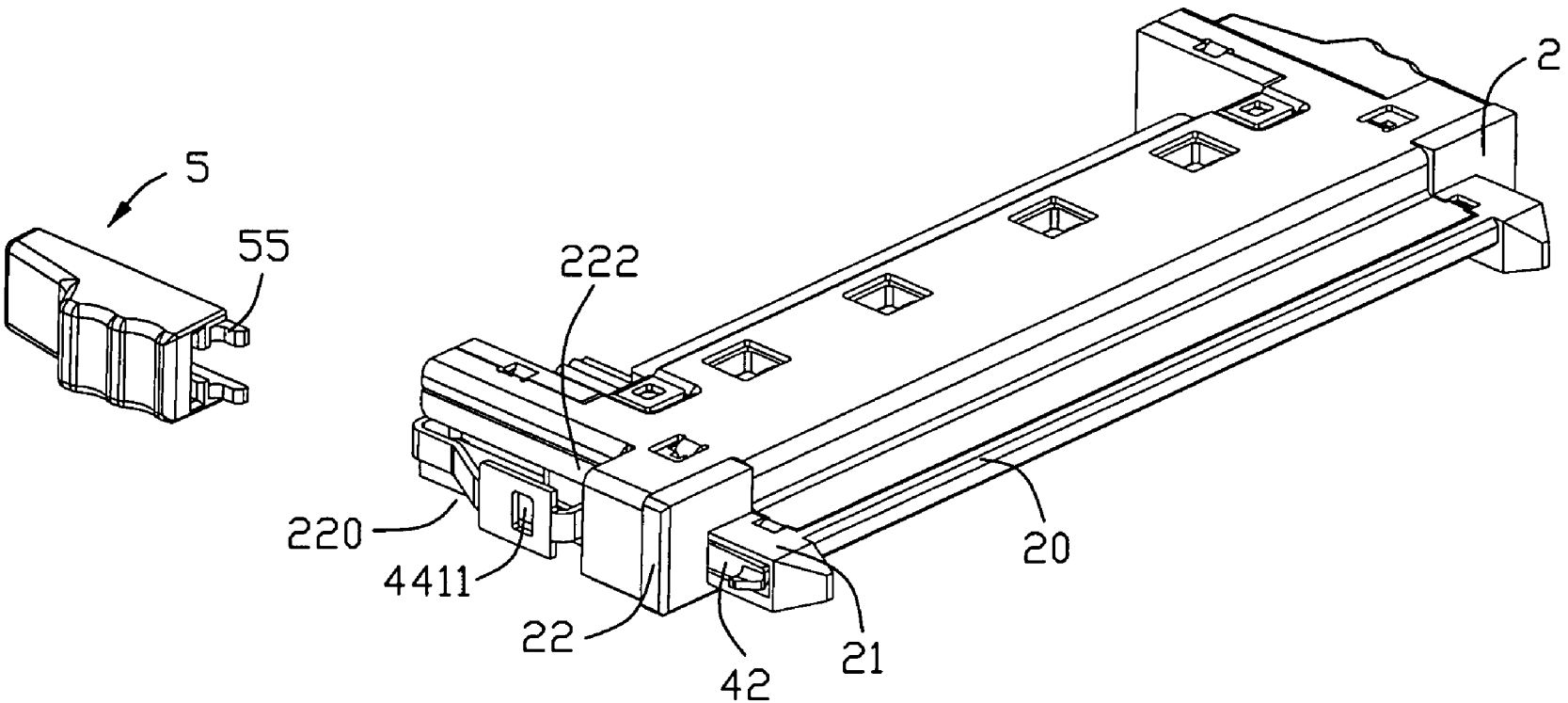
FIG. 2 is a perspective view of the electrical connector shown in FIG. 1 before a button is mounted.
Figure 3:
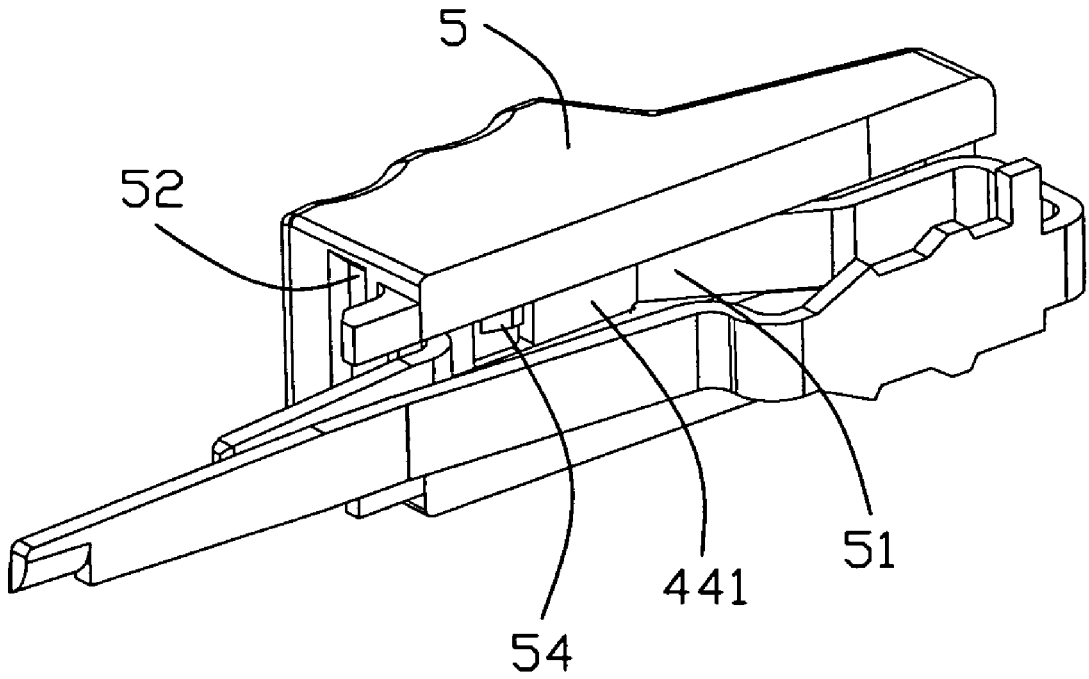
FIG. 3 is an assembled view of the button and the latch.
Figure 4:
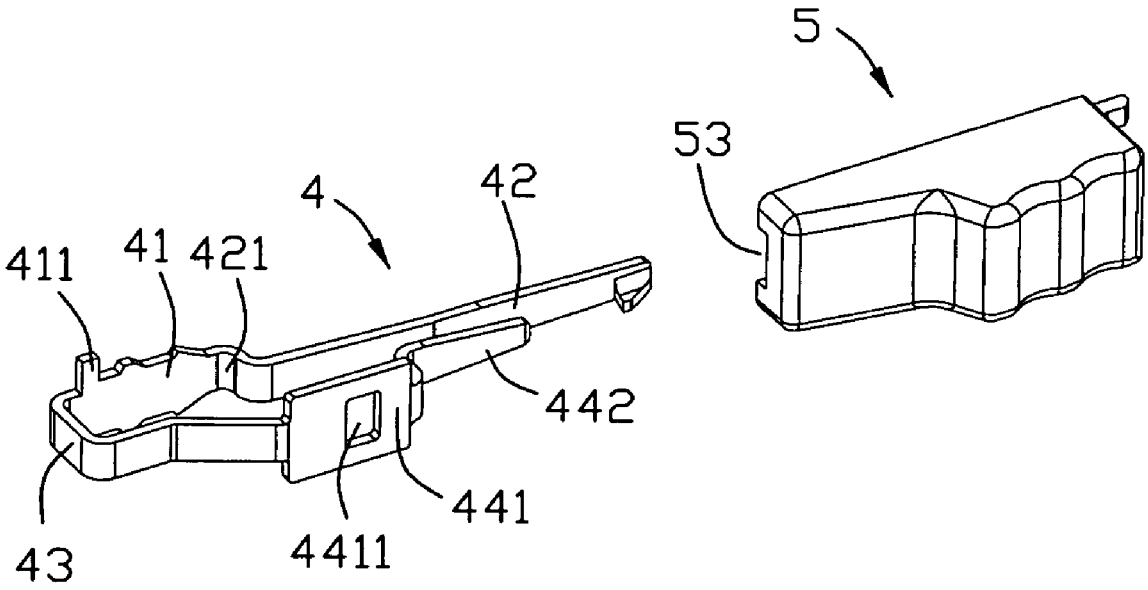
FIG. 4 is an exploded, perspective view of the button and the latch.

Please refer to FIGS. 2-4. The latch 4 comprises a holding portion 41 received in the arm portion 22 for holding the latch 4 in the insulator 2, an engaging portion 42 extending forwards from the front end of the holding portion 41 and received in the guide post 21 for engaging with a complementary connector, a spring portion 43 extending outwards and forwards from the rear end of the holding portion 41, and a pressed portion connecting with the spring portion 43 and located outside the engaging portion 42 to drive the engaging portion 42 by pressure. The pressed portion comprises an operating portion 441 extending forwards from the spring portion 43, a driving portion 442 extending forwards and inwards from the operating portion 441 to approach the engaging portion 42, and a button 5. The engaging portion 42 extends forwards and outwards from the holding portion 41 to approach the driving portion 442.

Referring to FIGS. 2-3, an outer side of the rear portion of the arm 22 is cut out to form a button receiving space 220, the button 5 is mounted on the operating portion 441 and received in the button receiving space 220. The operating portion 441 has a through-hole 4411, and the button 5 forms a recess 51 with a protrusion 54 for engaging with the through-hole 4411. The recess 51 has a pair of opening 52 and 53 at opposite front and rear ends to allow the latch 4 to slide into the recess 51.

Figure 5:
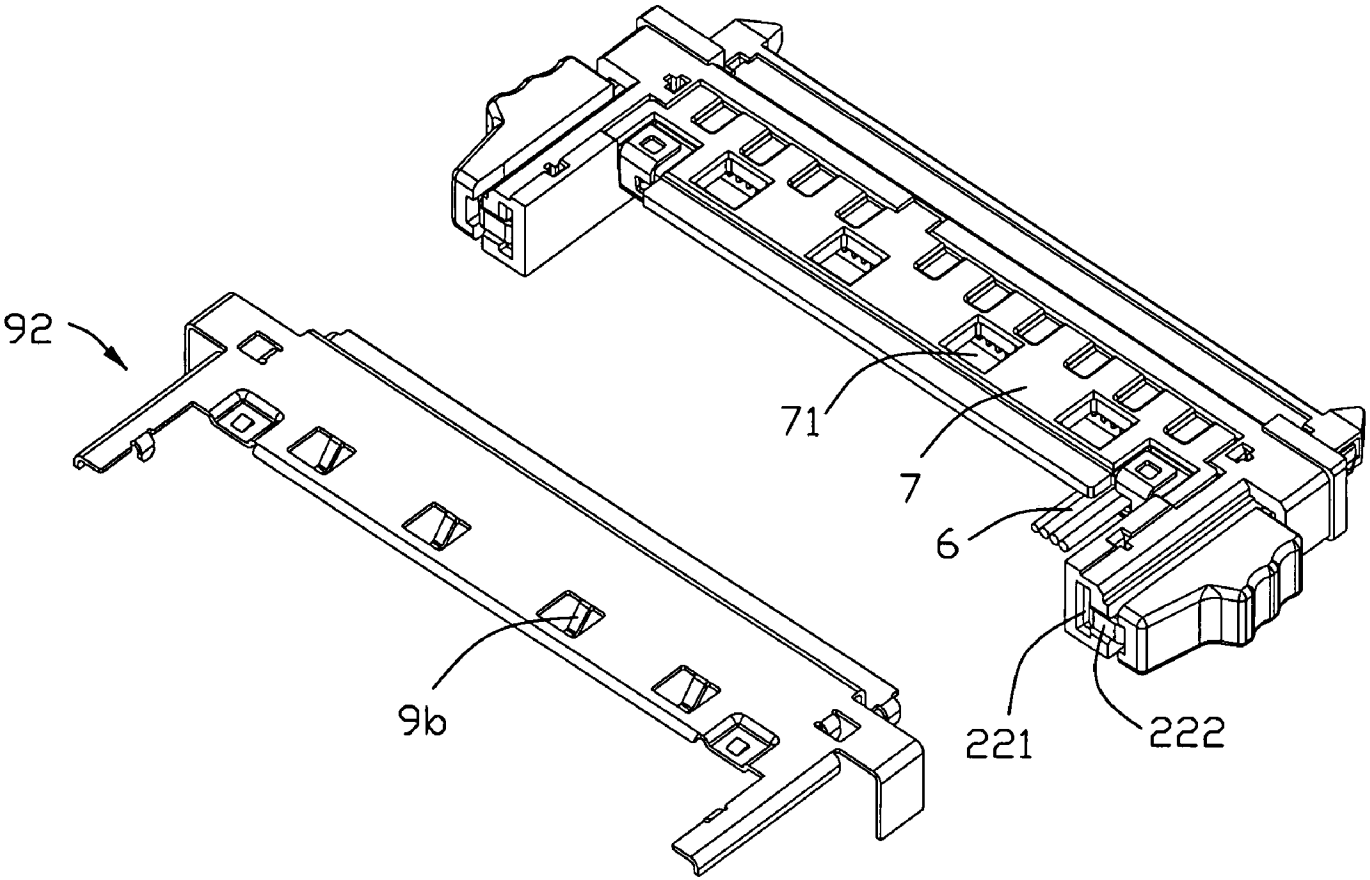
FIG. 5 is a perspective view of the electrical connector shown in FIG. 1 before a bottom shell is mounted.
Figure 6:
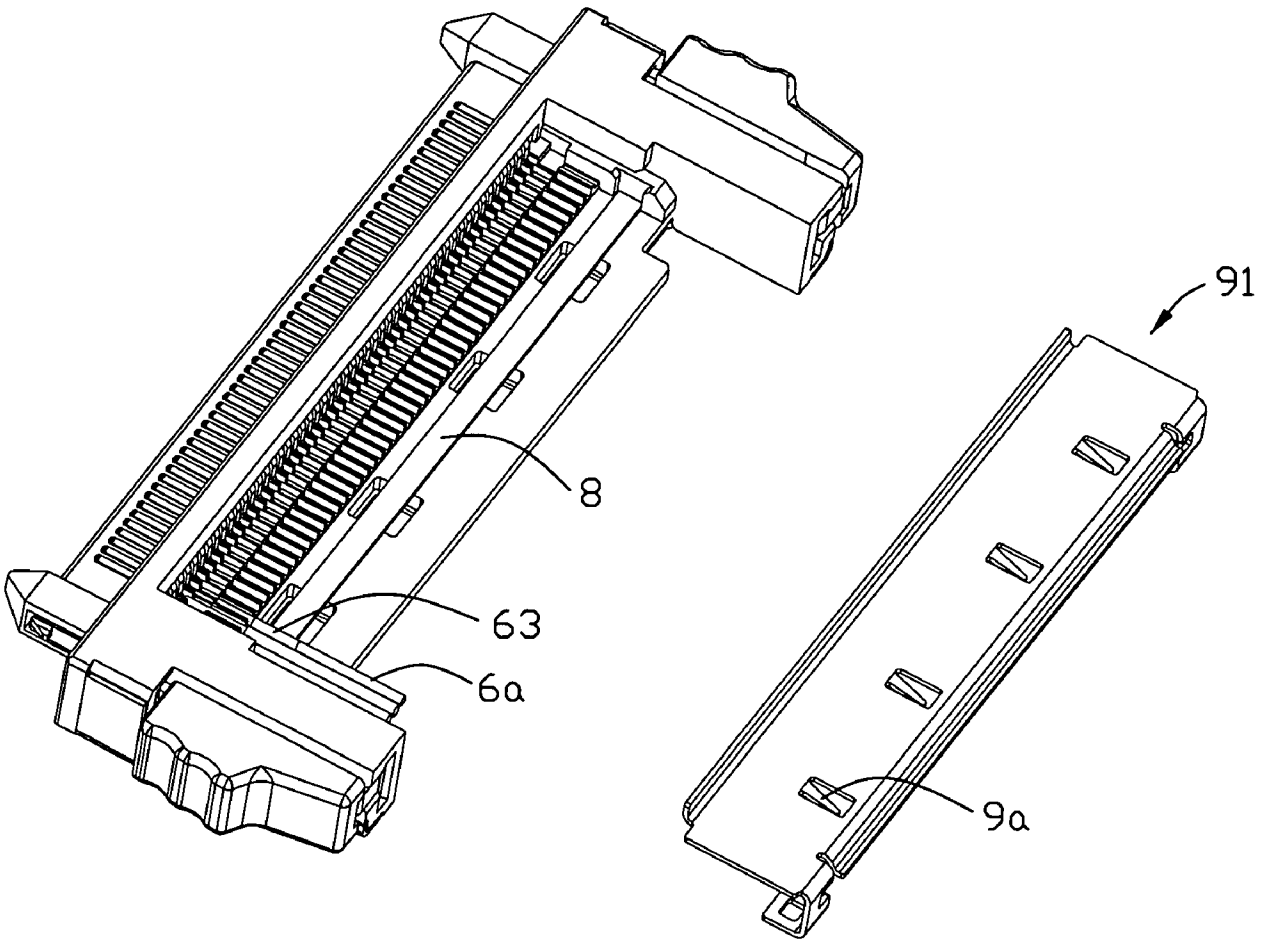
FIG. 6 is a perspective view of the electrical connector shown in FIG. 1 before a top shell is mounted.

Please refer to FIGS. 2 and 5. A slot 221 is formed through the arm portion 22 to receive and hold the holding portion 41 with heaves 411. A channel 222 is formed adjacent to the slot 221 to receive the spring portion 43. The channel 222 extends forwards into the guide post 21 to receive the engaging portion 42, and the channel 222 is configured to allow the engaging portion 42 to move inwards and outwards. The slot 221 and the channel 222 make up a recess for receiving the whole latch 4. Please refer to FIG. 2. A tip 55 is formed at the front end of the button 5 engages with the arm portion 22 to limit the movement of the button 5.

In this embodiment of the invention, the button 5 is held by the latch 4 and the insulator 2, so the electrical connector 100 doesn't need covers (shown in U.S. Pat. No. 6,558,183) which are mounted on the insulator 2 to hold the button 5. Moreover, that the button is received in the button receiving space 220 which is cut down at the rear end of the arm portion 22 is helpful to reduce the dimension of the electrical connector 100.

The arm portion 22 extends backwards beyond any other portion of the insulator 2 so as to receive the latch 4 with large dimension.

In operation, the driving portion 442 of the latch 4 moves down and presses upon the engaging portion 42 so as to unlock. The driving portion 442, the engaging portion 42 and the U-shaped spring portion 43 are elastic, so the latch has good elasticity to be effortlessly operated.

A spacer 7 is mounted between the pair of arm portions 22 to support the wires 6. A part of the wires 6 are micro coaxial cables, and each shielding layer 63 of the coaxial cables is soldered to the grounding bar 8.

A top shell 91 and a bottom shell 92 are mounted on the insulator 2 to shield the insulator 2. A plurality of spring fingers 9*a* and 9*b* are disposed on the top and bottom shells 91 and 92. The spring fingers 9*a* physically and electrically connect with the shielding layers 63 of the coaxial cable 6*a*. The spring fingers 9*b* pass through holes 71 of the spacer 7 and abut against the grounding bar 8. therefore, the top shell 91, the shielding layers 63, the grounding bar 8 and the bottom shell 92 establish a grounding path together.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

an insulator comprising a pair of guide posts on both sides of the front thereof and a pair of arm portions on both sides of the rear thereof, a recess disposed in the arm portion and extending into the guide post;

a conductive terminal held in the insulator; and a latch received and held in said recess of the insulator, the latch comprising a holding portion received in said arm portion for holding the latch in the insulator, an engaging portion extending forwards from the front of the holding portion and received in the guide post for engaging with a complementary connector, a spring portion extending outwards and forwards from the rear of the holding portion, and a driving portion extending forwards from the spring portion to approach the engaging portion so as to drive the engaging portion by pressure; and a button mounted on the spring portion and covering the latch; wherein an outer side of the rear portion of the arm is cut out to form a button receiving space, the button received in the button receiving space.

2. The electrical connector according to claim 1, wherein a tip is formed at the front end of the button engages with the arm portion to limit the movement of the button.

3. The electrical connector according to claim 1, wherein the engaging portion extends forwards and outwards from the holding portion.

4. The electrical connector according to claim 1, wherein the driving portion extends forwards and inwards from the spring portion to approach the engaging portion.

5. The electrical connector according to claim 4, wherein the engaging portion extends forwards and outwards from the holding portion.

6. An electrical connector, comprising:

an insulator comprising a pair of guide posts on both sides of the front thereof and a pair of arm portions on both sides of the rear thereof a recess disposed in the arm portion and extending into the guide post to receive a latch; and a conductive terminal held in the insulator;

the latch comprising a holding portion received in said arm portion for holding the latch in the insulator, an engaging portion extending forwards from a front end of the holding portion and received in the guide post for engaging with a complementary connector, a spring portion extending outwards and forwards from a rear end of the holding portion, and a pressed portion connecting with the spring portion and located outside the engaging portion to drive the engaging portion by pressure; and the pressed portion comprising an operating portion with a through-hole thereof, and a button having a recess with a protrusion for engaging with said through-hole, said operating portion received in said recess.

7. The electrical connector according to claim 6, wherein the arm portion extends backwards beyond any other portion of the insulator.

8. The electrical connector according to claim 6, wherein the engaging portion extends forwards and outwards from the holding portion.

9. The electrical connector as claimed in claim 6, wherein the pressed section further comprises a driving portion approaching to the eagaging portion for actuating the engaging portion when the pressed portion is pressed inwardly.

10. The electrical connector according to claim 6, wherein the pressed portion comprises an operating portion extending forwards from the spring portion and a driving portion extending forwards and inwards from the operating portion to approach the engaging portion.

11. The electrical connector according to claim 10, wherein the engaging portion extends forwards and outwards from the holding portion.

12. The electrical connector according to claim 11, wherein the pressed portion further comprises a button mounted on the operating portion and covering both the operating portion and the spring portion.

13. An electrical connector comprising;

an insulative housing defining a pair of guiding posts at two opposite longitudinal ends thereof;

a plurality of contacts disposed in the housing;

a pair of latches associated with the corresponding pair of guiding posts, respectively, each of said latch being of roughly a U-shaped configuration, in a side view, with an inner arm and an outer arm thereof, a retention section being located at a rear portion of the inner arm, a hook section located at a tip of a front portion of the inner arm, and a button attached to the outer arm; wherein the outer arm is shorter than the inner arm, and a front portion of said outer arm actuates said front portion of the inner arm when the button is pressed inwardly.

14. The electrical connector as claimed in claim 13, wherein the inner arm extends in a Z-shaped configuration in said side view.

15. The electrical connector as claimed in claim 13, wherein the outer arm extends in a trough like configuration in said side view.

* * * * *